US009302508B2

(12) United States Patent
Ogimura

(10) Patent No.: US 9,302,508 B2
(45) Date of Patent: Apr. 5, 2016

(54) PRINT APPARATUS

(71) Applicant: SEIKO EPSON CORPORATION, Tokyo (JP)

(72) Inventor: Takafumi Ogimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/595,649

(22) Filed: Jan. 13, 2015

(65) Prior Publication Data

US 2015/0224797 A1 Aug. 13, 2015

(30) Foreign Application Priority Data

Feb. 12, 2014 (JP) ..... 2014-024152

(51) Int. Cl.

| | |
|---|---|
| ***B41J 29/38*** | (2006.01) |
| ***B41J 29/393*** | (2006.01) |
| ***B41J 11/00*** | (2006.01) |
| ***B41J 11/06*** | (2006.01) |
| ***B41J 13/14*** | (2006.01) |

(52) U.S. Cl.

CPC ..... *B41J 11/009* (2013.01); *B41J 11/003* (2013.01); *B41J 11/005* (2013.01); *B41J 11/06* (2013.01); *B41J 13/14* (2013.01)

(58) Field of Classification Search

CPC ..... B41J 11/003; B41J 11/0025

See application file for complete search history.

(56) References Cited

U.S. PATENT DOCUMENTS

2013/0257973 A1* 10/2013 Tamura ..... 347/19
2014/0035985 A1* 2/2014 Arakane et al. ..... 347/16

FOREIGN PATENT DOCUMENTS

JP 08-002027 A 1/1996
JP 2005081750 A * 3/2005

OTHER PUBLICATIONS

Machine generated English translation of JP2005-081750A to Kajiwara, Riki, "Printer, and Method for Detecting End of Printing Paper"; retrieved via https://www.j-platpat.inpit.go.jp/web/all/top/BTmTopEnglishPage on Jul. 24, 2015; 22 pp.*

* cited by examiner

*Primary Examiner* — Shelby Fidler
(74) *Attorney, Agent, or Firm* — Global IP Counselors, LLP

(57) ABSTRACT

A print apparatus includes a conveyance unit configured to convey a print medium over a plurality of convexities that are arranged along a direction of scanning and the control unit. When one end position of the print medium has been detected by a detection unit, in a case where the one end position is a position that overlaps with position of the convexities stored in a storage unit, the control unit is configured to control a detection of the other end position of the print medium and determine the one end position on the basis of the other end position.

8 Claims, 7 Drawing Sheets

PRINT APPARATUS

CROSS-REFERENCE TO RELATED APPLICATIONS

This application claims priority to Japanese Patent Application No. 2014-024152 filed on Feb. 12, 2014. The entire disclosure of Japanese Patent Application No. 2014-024152 is hereby incorporated herein by reference.

BACKGROUND

1. Technical Field

The present invention relates to a print apparatus provided with a function for detecting an end of a print medium.

2. Related Art

With this type of print apparatus, printing is carried out by a print head onto a print medium such as paper that is fed out. With, for example, a serial-type print apparatus, the print head moves in a direction of scanning along with a carriage and ejects ink onto the surface of the printer in the course of this movement, thus printing an image or the like. Provided to a position facing a scanning region of the carriage is a support base that extends along the direction of scanning of the carriage and that projects out in a state where a plurality of ribs (convexities) supporting the paper are spaced in the direction of scanning.

There is also a known print apparatus provided with a function for detecting end positions of the paper or the width of the paper by using a non-contact sensor (for example, an optical sensor) provided to the carriage to sense ends (side ends) of the paper in the direction of scanning by receiving reflected light of light that has been irradiated towards the paper side by the sensor during the scanning of the carriage For example, Japanese laid-open patent publication No. H8-2027 discloses the configuration of a print apparatus provided with a paper width detecting means, wherein a sensor (sensing unit) provided to the carriage irradiates grooves formed on the support base (a guide) with light in order to prevent a malfunction of side end detection of the paper that is caused by when a surface treatment layer of the support base (a guide) is peeled off by abrasion between the support base and the paper and the light reflectance thereof is changed.

However, forming the grooves on the support base causes the paper to be contaminated by ink, paper dust, or the like that has collected in the grooves. Therefore, in a print apparatus of a configuration where the paper is supported with a plurality of ribs, each of the ribs is arranged at a position that essentially does not overlap with the side ends of the paper (which may be, for example, fixed-form paper).

However, the end positions of the paper do sometimes end up overlapping with the positions of the ribs, due to skewing during the feeding of the paper or to positional displacement of the paper in the direction of scanning. Additionally, in the case of paper other than fixed-form paper, the end positions of the paper end up overlapping with the positions of the ribs even though the paper may be fed out correctly. In such cases, when the abrasion with the paper causes considerable loss of the reflection-preventing surface treatment layer applied to the surfaces of the ribs and raises the light reflectance of the ribs, the light reflected from the ribs will result in false detection of the ends of the paper. The fact that abrasion of the ribs is inevitable means that it is necessary to prevent false detection of the end positions in a case where the ends of the paper have overlapped with the positions of the ribs, even when the ribs have been abraded.

SUMMARY

The present invention has been made in order to solve the aforementioned problem, and an objective thereof is to provide a print apparatus with which the end positions of a print medium can be more accurately determined even in a case where the end positions of the print medium have overlapped with the positions of convexities.

Means for solving the problem shall be described below, as shall effects thereof.

A print apparatus for solving the aforementioned problem comprises: a carriage which includes a print head configured to print onto a print medium and a non-contact detection unit configured to detect ends of the print medium in a direction of scanning intersecting with a direction of conveyance of the print medium, and which is configured to scan in the direction of scanning; a plurality of convexities arranged at positions facing a scanning region of the carriage and arranged along the direction of scanning in a state of extending along the direction of conveyance; a conveyance unit configured to convey the print medium over the convexities; a storage unit configured to store the positions of the convexities; and a control unit configured to control the print apparatus. When the non-contact detection unit detects one end position of the print medium, in a case where the one end position is a position that overlaps with positions of the convexities stored in the storage unit, the control unit is configured to control the non-contact detection unit to detect the other end position of the print medium and configured to determine the one end position on the basis of the other end position.

Herein, "determine the one end position" is not limited to directly finding the one end position; the concept also encompasses a case where the one end position is determined indirectly by finding a specific position (for example, a print start position or a mask position) that is determined unambiguously when the one end position is determined.

According to this configuration, when the one end position of the print medium is detected by the non-contact detection unit, in a case where the one end position as detected is a position that overlaps with the position of a convexity stored in the storage unit, then the other end position of the print medium is detected and the one end position is determined on the basis of the other end position. For this reason, the one end position of the print medium can be determined relatively accurately even when the end position of the print medium overlaps with the position of a convexity and the accuracy of detection of the one end position by the detection unit is decreased.

In the aforementioned print apparatus, preferably, the one end position is determined by comparing the other end position as detected by the non-contact detection unit with a theoretical position of the other end position as based on information about the print medium.

According to this configuration, the one end position is determined by comparing the other end position as detected by the detection unit with a theoretical position of the other end position as based on information about the print medium. Accordingly, the one end position can be determined even more accurately.

In the aforementioned print apparatus, preferably, the other end position is not detected in a case where the one end position is a position that does not overlap with the convexities.

According to this configuration, there is no detection of the other end position in a case where the one end position is a position that does not overlap with the convexities, and therefore the requisite time needed to detect the end position can be reduced by a commensurate amount.

In the aforementioned print apparatus, preferably, the positions of the plurality of the convexities are set such that the other end position is a position that does not overlap with the positions of the convexities in a case where the one end position is a position that overlaps with the convexities.

According to this configuration, the other end position will be a position that does not overlap with the positions of the convexities in a case where the one end position is a position that does overlap with the convexities, and therefore the other end position can be accurately detected without hindrance from the convexities. As a result, the one end position can be accurately determined on the basis of the other end position.

Moreover, in the aforementioned print apparatus, preferably, the control unit is configured to determine the one end position on the basis of an actually measured value based on both of the one end position and the other end position in a case where the one end position and the other end position have both been detected.

According to this configuration, the one end position is determined on the basis of an actually measured value based on both of the end positions in a case where the one end position and the other end position have both been detected, and therefore the one end position can be accurately determined.

In the aforementioned print apparatus, preferably, in a case where a light reflectance of the convexities is deemed to be a threshold value or below, the control unit is configured not to control the non-contact detection unit to detect the other end position in a case where the one end position and the positions of the convexities do overlap.

According to this configuration, in a case where the light reflectance of the convexities is deemed to be a threshold value or below, then the other end position is not detected even in a case where the one end position and the position of a convexity do overlap, and therefore the requisite time needed to detect the end position can be reduced by a commensurate amount.

In the aforementioned print apparatus, preferably, the control unit is further configured to find a width of the print medium in the direction of scanning, as the actually measured value, on the basis of both of the one end position and the other end position, and determine the one end position on the basis of the width and the other end position.

According to this configuration, in a case where both of the end positions have been detected, then the width of the print medium in the direction of scanning is found as the actually measured value on the basis of both of the end positions, and the one end position is determined on the basis of the actually measured width and the other end position. Accordingly, the one end position can be accurately determined on the basis of an actually measured value.

In the aforementioned print apparatus, preferably, the control unit is configured to directly or indirectly detect an index indicative of an extent of abrasion of the convexities, and in a case where the index is a threshold value or below, and in a case where the one end position as detected and the position of a convexity stored in the storage unit overlap, the control unit is configured not to control the non-contact detection unit to detect the other end position, in a case where the index exceeds the threshold value, and in a case where the one end position as detected by the detection unit is a position that overlaps with the positions of the convexities, the control unit is configured to control the non-contact detection unit to detect the other end position, and the one end position is determined on the basis of the other end position.

According to this configuration, in a case where the index indicative of the extent of abrasion of the convexities is the threshold value or below, then the other end position is not detected even in a case where the one end position as detected and the position of a convexity stored in the storage unit do overlap. For this reason, the need for a detection operation in order to detect the other end position can be obviated, and the requisite time needed to determine the one end position can be shortened. In a case where the index indicative of the extent of abrasion of the convexities does exceed the threshold value, however, then where the one end position as detected by the detection unit is a position that overlaps with the position of a convexity stored in the storage unit, the other end position is detected and the one end position is determined on the basis of the other end position. Accordingly, the one end position can be accurately determined even in a case where the extent of abrasion of the convexities has exceeded the threshold value.

BRIEF DESCRIPTION OF THE DRAWINGS

Referring now to the attached drawings which form a part of this original disclosure.

DETAILED DESCRIPTION OF EXEMPLARY EMBODIMENTS

An embodiment in the form of a printer serving as an example of a print apparatus shall be described below with reference to the accompanying drawings.

Figure 1:
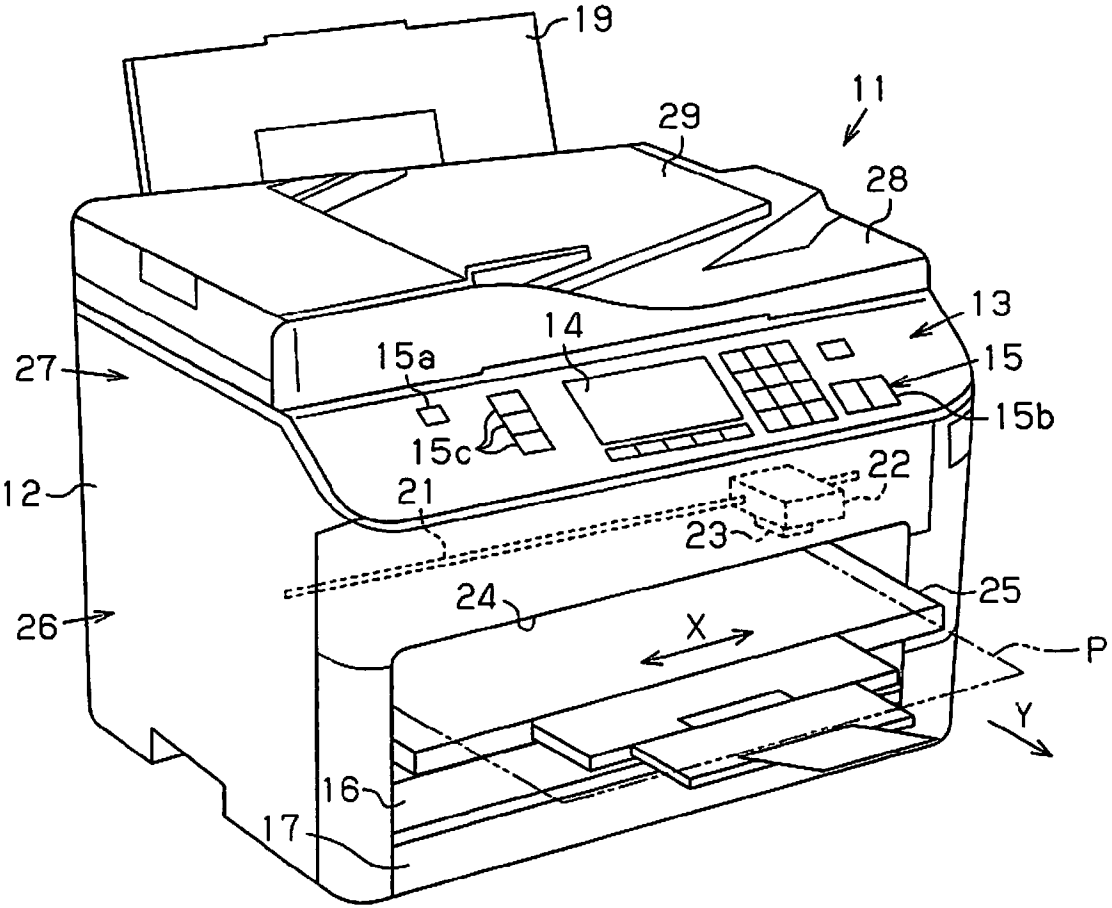
FIG. 1 is a perspective view illustrating a printer in one embodiment.

A printer 11 illustrated in FIG. 1 is a multifunction peripheral offering a scan function, a print function, a copy function, and a facsimile function. The printer 11 is provided with an apparatus main body 12 having a substantially rectangular parallelepiped shape, and an operation panel 13 provided to a front surface (which, in FIG. 1, is the right-hand front surface) of the apparatus main body 12. Provided to the operation panel 13 are a display unit 14 and an operation unit 15 composed of a plurality of operation switches. The operation unit 15 includes a power source switch 15*a*, a print start button 15*b*, a mode switching button 15*c* for switching between a variety of modes, and the like. The display unit 14 of the present embodiment is a touch panel with which content corresponding to a button displayed on a screen thereof can be selected and inputted when that button is touched; this touch panel function also constitutes a part of the operation unit.

As illustrated in FIG. 1, a front surface lower part of the apparatus main body 12 has mounted thereon a plurality (two, in the example in FIG. 1) of feeding cassettes 16, 17 able to accommodate a plurality (for example, a value in the range of 100 to 1,000 sheets) of sheets of paper P, serving as one example of a print medium, the feeding cassettes being mounted in a state of being detachable with respect to accommodating recesses provided separately to corresponding places of the apparatus main body 12. A manual-type feeding tray 19 which is arranged at an inclined posture is provided to a back surface side of the apparatus main body 12.

The paper P that is fed from one of the plurality of feeding cassettes 16, 17 is conveyed as far as a print start position along a direction of conveyance Y after having reversed along a paper reversal path (not shown) arranged on the back surface side inside the apparatus main body 12. By contrast, the paper P that is fed from the feeding tray 19 is conveyed to the print start position by way of a shorter feeding distance. For this reason, the paper P that is fed from one of the feeding cassettes 16, 17 more readily experiences skewing where the paper becomes somewhat more diagonal or positional displacement in a direction of scanning X intersecting with the direction of conveyance Y, as compared to the paper that is fed from the feeding tray 19.

As illustrated in FIG. 1, a carriage 22 that is guided by a guide shaft 21 extending in the direction of scanning X (which is the width direction in the present example) and is able to move reciprocally is provided inside the apparatus main body 12. A print head 23 that is arranged on a lower part of the carriage 22 has a plurality of nozzles able to eject ink droplets onto the paper P being conveyed (illustrated with the two-dot chain line in FIG. 1). The carriage 22 moves reciprocally in the direction of scanning X and, meanwhile, a document, image, or the like is printed onto a surface of the paper P by the ejection of the ink droplets from the nozzles during this movement. The printed paper P is then fed in the direction of conveyance Y and discharged from a discharge port 24 that opens at a front middle position of the apparatus main body 12 and stacked onto, for example, a sliding-type discharge stacker 25 (discharge tray) that is in an extended state.

The printer 11 is a color printer, by way of example. The print head 23 has formed thereon a plurality of nozzle columns of the same number as that of a plurality of ink colors (for example, a number of colors in the range of four to ten colors) comprising, for example, cyan (C), magenta (M), yellow (Y), and black (K) for ejecting, color by color, ink that is supplied from ink supply sources (ink cartridges or ink tanks, for example) (not shown) accommodating the plurality of colors of inks. The printer 11 may also be a monochrome printer capable only of printing grey scale.

In the printer 11 illustrated in FIG. 1, the lower part of the apparatus main body 12 serves as an image formation unit 26 for forming an image on the paper P by the aforementioned printing, and a scanner unit 27 is arranged on an upper side thereof. The scanner unit 27 has a document platen (not shown) having a document reading surface at an upper surface part of the apparatus main body 12, and a cover 28 provided so as to be able to open and close with respect to the document platen on an upper side of the apparatus main body 12.

An automatic document feeding unit 29 (automatic document feeder) with which a plurality of document sheets are placed and fed one sheet at a time to the scanner unit 27 is provided to an upper part of the cover 28.

Figure 2:
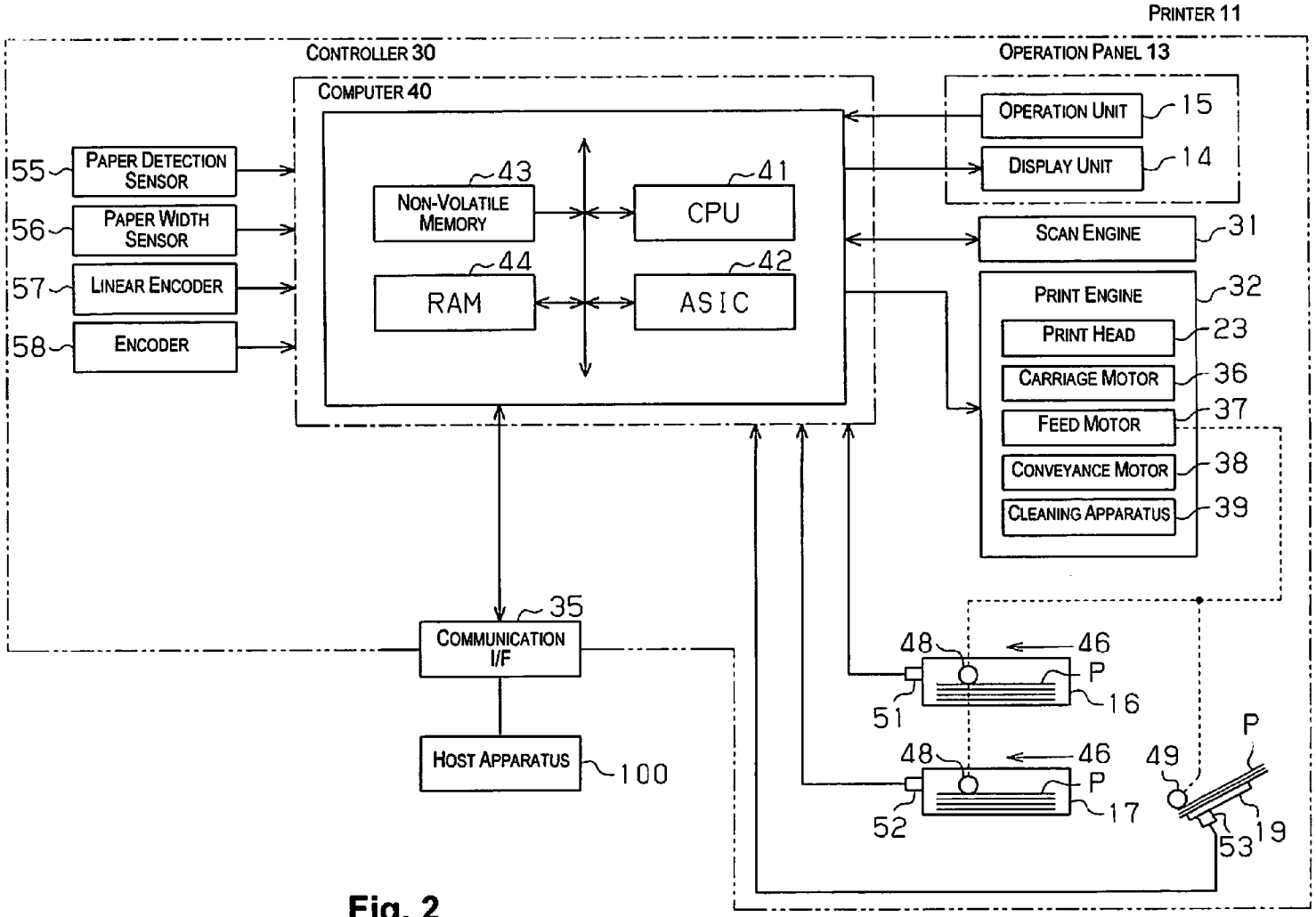
FIG. 2 is a block diagram illustrating an electrical configuration of a printer.

Next, an electrical configuration of the printer 11 shall be described with reference to FIG. 2. As illustrated in FIG. 2, the printer 11 is provided with a controller 30 for governing the overall control thereof, the operation panel 13, a scan engine 31, a print engine 32, and the like. The printer 11 is also provided with a communication interface (called a "communication I/F 35" hereinbelow). The scan engine 31 is provided with a scan head having a line sensor, an electric motor serving as a source of power for the scan head, a lamp for illuminating a reading location of the line sensor, and the like.

The print engine 32 illustrated in FIG. 2 is provided with: a carriage motor 36 serving as a source of power for the print head 23 and the carriage 22; a feed motor 37 serving as a source of power for feeding the paper P from the feeding cassettes 16, 17, the feeding tray 19, or the like; a conveyance motor 38 serving as a source of power for conveying the paper P that has been fed out; a cleaning apparatus 39 for cleaning the print head 23; and the like. The controller 30 controls the driving of the print engine and prints onto the paper P on the basis of print data. The controller 30 also "copies" documents by controlling the driving of the scan engine 31 and the print engine 32 and causing the print engine 32 to print an image that is based on document data that has been read with the scan engine 31.

The controller 30 also prints a document, and image, or the like by controlling the driving of the print engine 32 on the basis of print data that has been received via the communication I/F 35 from a host apparatus 100. A personal computer, a portable information terminal (personal digital assistant, PDA), tablet PC, smartphone, or the like is used as the host apparatus 100.

The controller 30 illustrated in FIG. 2 is provided with a computer 40. The computer 40 is provided with a central processing unit (CPU) 41, an application specific IC (ASIC) 42, and a non-volatile memory 43 serving as one example of a storage unit, and a RAM 44.

Figure 8:
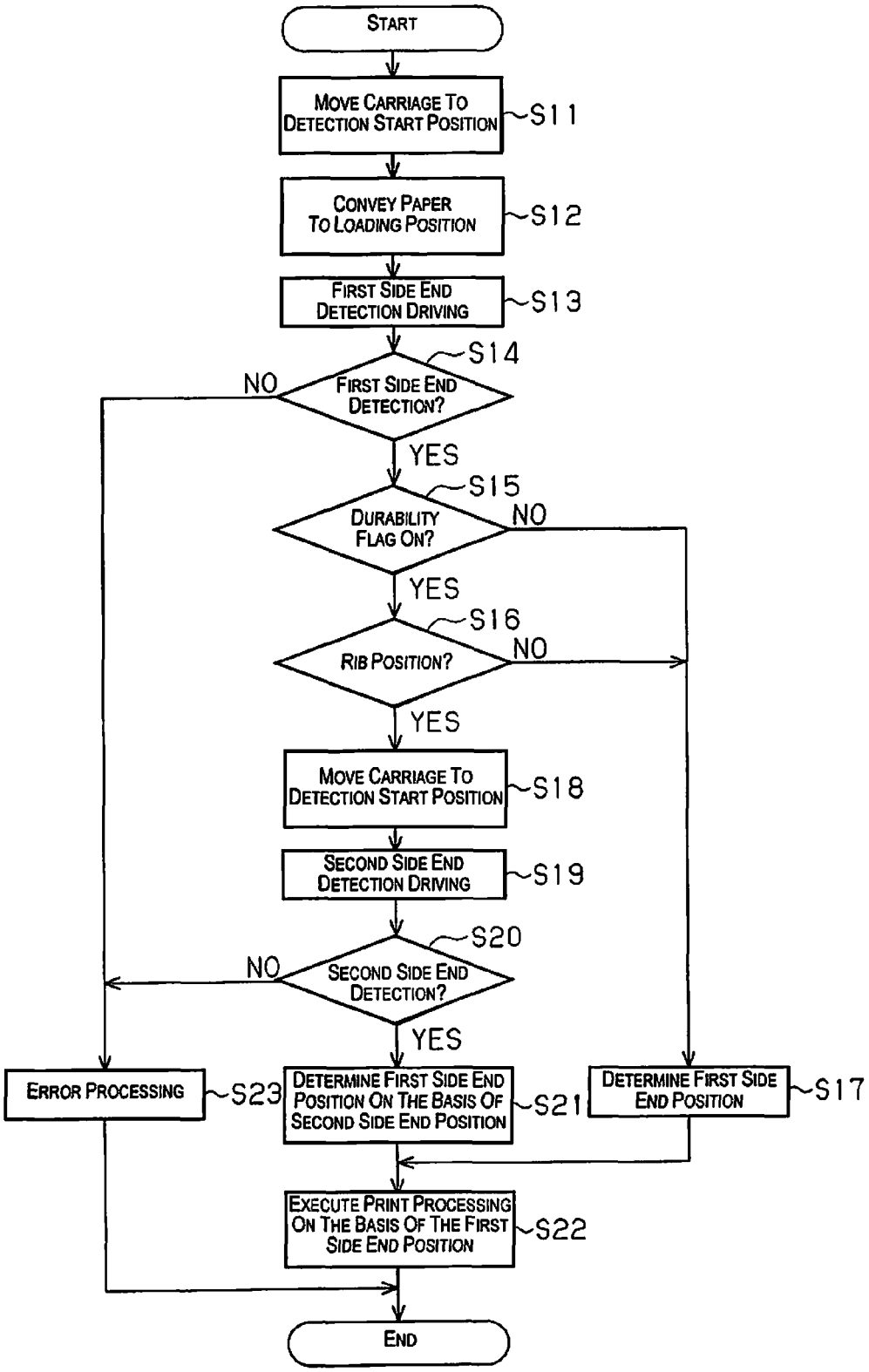
FIG. 8 is a flow chart for describing a paper end detection control program.

The non-volatile memory 43 stores: a variety of programs, including a control program illustrated in FIG. 8 for carrying out an end detection process for detecting side end positions (one example of end positions) of the paper P; and a variety of data, including rib positional data RD (see FIG. 4) used for the side end detection process.

As Illustrated in FIG. 2, a feed drive unit 46 for sending the paper P out one sheet at a time from each of the feeding cassettes 16, 17 is provided inside the apparatus main body 12 for every feeding cassette, the source of driving for the feed drive units 46 being the feed motor 37. Each of the feed drive units 46 is provided with a feed roller 48 (pickup roller) for sending out, to the downstream side in a direction of feeding, the uppermost sheet out of the group of sheets of paper that have been placed in the feeding cassettes 16, 17. A feed roller 49 provided to a position in the vicinity of a proximal end of the feeding tray 19 is rotatingly driven with the power of the feed motor 37 and thereby causes the uppermost sheet of the group of sheets of paper on the feeding tray 19 out to the downstream side in the direction of feeding.

As illustrated in FIG. 2, connected to an input terminal of the controller 30 are tray sensors 51, 52 capable of sensing removal and mounting of the feeding cassettes 16, 17 and a paper presence or absence sensor 53 capable of sensing the presence or absence of the paper P on the feeding tray 19. Also electrically connected to an input terminal of the controller 30 are a paper detection sensor 55, a paper width sensor 56, a linear encoder 57, and an encoder 58.

The paper detection sensor 55 is, for example, a contact-type or non-contact-type switch-type sensor provided to a predetermined position on a feed path, and sensors a leading end of the fed paper P in the direction of conveyance Y.

The paper width sensor 56 is a non-contact sensor provided to the carriage 22, and detects a side end of the paper P in the direction of scanning X intersecting with the direction of conveyance Y. The paper width sensor 56 of the present example is composed of a reflective optical sensor having a light-emitting unit capable of irradiating with light and a light-receiving unit capable of receiving reflected light of the light irradiated from the light-emitting unit. It shall be readily understood that the paper width sensor 56 may be a transmissive optical sensor configured to detect the side end of the paper P by when the paper P blocks light that is passing between a light-emitting unit and a light-receiving unit on both sides of a conveyance path.

The linear encoder 57 outputs a pulse signal having a number of pulses that is proportional to the amount of movement by the carriage 22, i.e., the amount of rotation of the carriage motor. The encoder 58 outputs a pulse signal having a number of pulses that is proportional to the amount of rotation of the conveyance motor 38.

The controller 30 causes a PF counter (not shown) to count a number of edges of the pulses coming from the encoder 58 when the paper detection sensor 55 senses the leading end of the paper P. For this reason, the controller 30 acquires from the PF counter a count value corresponding to the position (conveyance position) of the paper P in the direction of conveyance Y for which the origin is the position of when the leading end of the paper P was sensed by the paper detection sensor 55.

The controller 30 monitors a detection voltage inputted from the paper width sensor when the carriage motor 36 has been driven and the carriage 22 has moved in the direction of scanning, and acquires the side end position of the paper P from the carriage position (namely, the count value of a CR counter) of when the detection voltage thereof has crossed over a predetermined threshold value. The distance in the direction of scanning X between the carriage position and the position of arrangement of the paper width sensor 56 is already known, and therefore the side end position of the paper P is found from this known distance and the carriage position.

Figure 3:
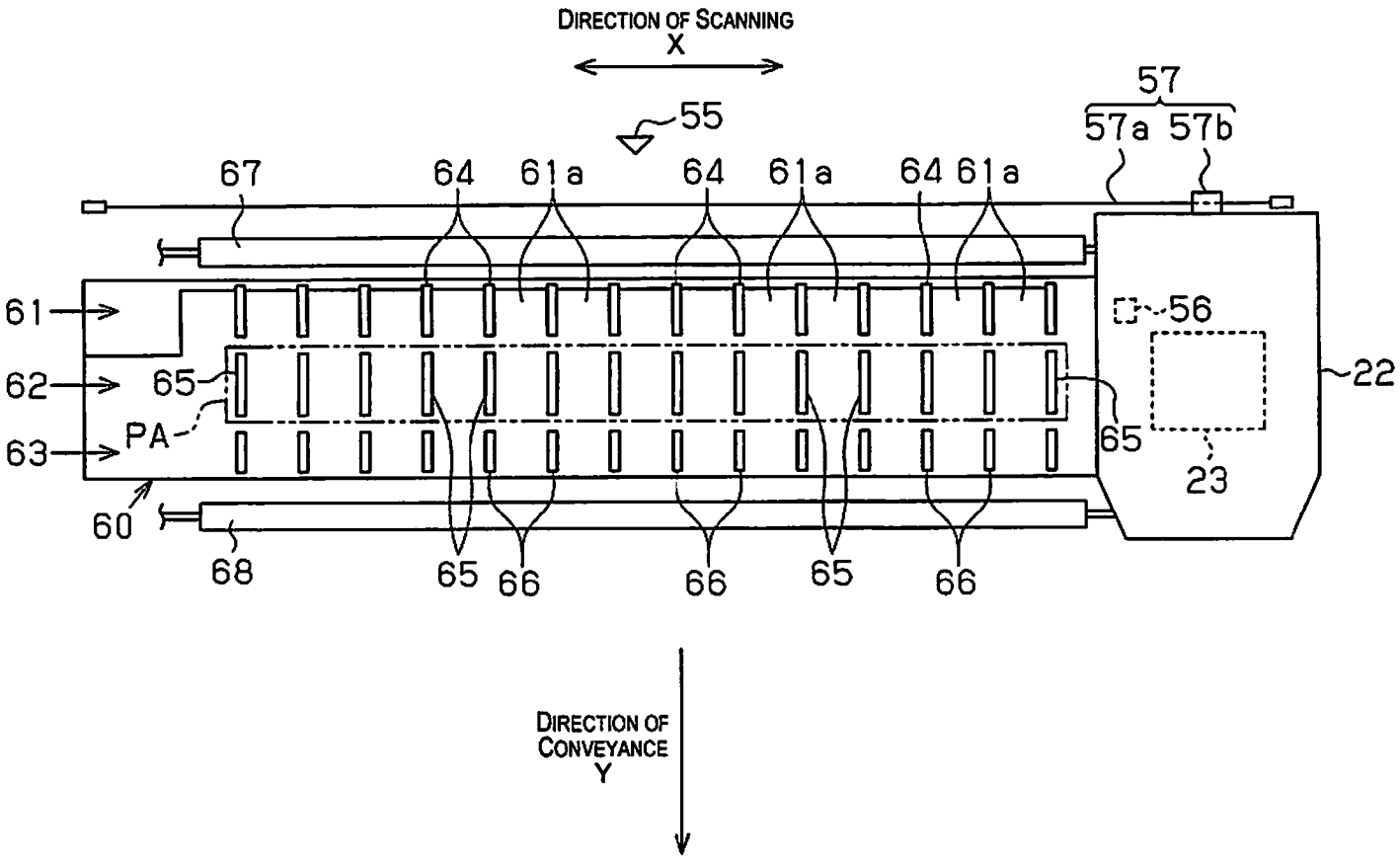
FIG. 3 is a schematic plan view illustrating a support base and a carriage.

Next, the configuration of a print unit with which printing onto the paper P is carried out shall now be described with reference to FIG. 3. As illustrated in FIG. 3, an elongated support base 60 extending along the direction of scanning X is provided to the print unit, to a position facing a region (also called a "scan region") where the carriage 22 is scanned. On the support base 60, there are an upstream support surface part 61 located on the upstream side in the direction of conveyance Y, a middle support surface part 62 located on the downstream side in the direction of conveyance Y with respect to the upstream support surface part 61, and a downstream support surface part 63 located on the downstream side in the direction of conveyance Y with respect to the middle support surface part 62.

As illustrated in FIG. 3, a plurality of first ribs 64, second ribs 65, and third ribs 66 serving as one example of convexities, which project out vertically upward (the near side in FIG. 3) and extend along the direction of conveyance Y, are formed on each of the support surface parts 61 to 63, respectively, each at regular intervals in the direction of scanning X. The paper P (see FIG. 1) is conveyed in the direction of conveyance Y in a state where a reverse surface is supported on the first through third ribs 64 to 66. In FIG. 3, a print region PA is set over the support base 60, the print region PA being the maximum region in which the liquid is ejected by the print head 23 in the direction of scanning X.

The linear encoder 57 has a code plate 57*a* having a large number of slits that open at a regular pitch along the direction of scanning, and a sensor 57*b* for receiving, with a light-receiving unit, light that has been emitted from a light-projecting unit and passed through the slits; a pulse signal having a number of pulses that is proportional to the amount of rotation of the carriage motor 36 is outputted from the sensor 57*b*.

As illustrated in FIG. 3, a conveyance roller pair 67 and a discharge roller pair 68 are provided to the upstream side and the downstream side, respectively, across the support base 60 in the direction of conveyance Y. The paper P is conveyed in the direction of conveyance Y in a state of being sandwiched (nipped) by the two roller pairs 67, 68, which are rotated by the power of the conveyance motor 38. In the present embodiment, the constituent components of a conveyance system, such as the feed motor 37, the feed rollers 48, 49, the conveyance motor 38, the conveyance roller pair 67, and the discharge roller pair 68 together constitute one example of a conveyance unit.

As illustrated in FIG. 3, a portion of the upstream support surface part 61 other than the first ribs 64 makes recesses 61*a* that have a lower bottom surface than the top surfaces (upper end surfaces) of the first ribs 64. After completion of a document loading operation for conveying the paper P in the direction of conveyance Y to a print start position, the computer 40 carries out side end detection driving in which the carriage 22 moves in the direction of scanning X, and the side end position of the paper P is detected on the basis of the detection signal coming from the paper width sensor 56 during this process of movement.

In the serial-type printer 11, a document, an image, or the like is printed onto the paper P by alternating repetition of a printing operation for ejecting the ink onto the paper P from the nozzles of the print head 23 while the carriage 22 is being moved reciprocally in the direction of scanning X, and a feed operation for conveying the paper P by the amount of conveyance to the next position of recording in the direction of conveyance Y. The side end position of the paper P as detected in the side end detection driving is used to determine the print start position (ejection start position) at which the ejection of ink from the print head 23 is started, for each pass traveled once by the carriage 22 moving one time in the direction of scanning X. For this reason, positional displacement of a printed image in the direction of scanning X with respect to the paper P can be suppressed.

Next, the positional relationship between the first ribs 64 and the paper P during the side end detection driving shall now be described with reference to FIG. 5. As illustrated in FIG. 5, the first ribs 64 form a trapezoidal shape in front view as seen from the downstream side in the direction of conveyance, and have a top surface 64*a* (upper end surface) that is highest and two side surfaces 64*b*, 4*b* that extend obliquely on both sides of the direction of scanning X. The areas between the first ribs 64 serve as the recesses 61*a*, and the paper P is supported by the top surfaces 64*a* of the plurality of first ribs 64, as illustrated in FIG. 5. Herein, a side end on a home position side (which is the right side in FIG. 5) out of the two side ends of the paper P in the width direction (direction of scanning X) shall be called a "first side end SE1", and the side end of the opposite side to the first side end in the width direction of the paper P shall be called a "second side end SE2".

The printer 11 of the present embodiment has a draft mode (high-speed printing mode), a high-quality mode (low-speed printing mode), a double-sided printing mode, and the like as print modes. The printer 11 employs two different kinds of side end detection method, depending on the print mode, as the method for detecting the side end position of the paper P. The first method is a method for detecting the first side end SE1 of the paper P in the width direction and determining the position of the first side end SE1. The second method is a method for detecting both the first side end SE1 and the second side end SE2 of the paper P in the width direction, and determining the paper width (length of the paper in the width direction) as well as the position of the first side end SE1 on the basis of the data for both side end positions.

The question of which print mode of the plurality of print modes shall take the first method and which other print mode shall take the second method is stored in advance in the non-volatile memory 43. The computer 40 determines whether a process for detecting the side end(s) of the paper P that is carried out during feeding should be executed with the first method or executed with the second method on the basis of the print mode, which is either selected by the user or specified in print job data.

Figure 5A:
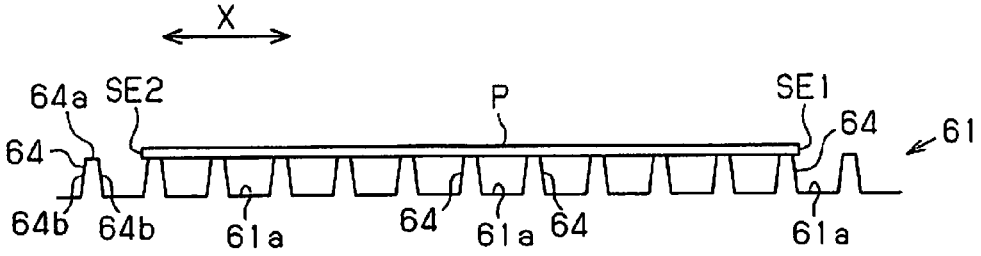
FIGS. 5A and 5B are schematic front views illustrating a state where paper is supported on ribs without displacement in a direction of scanning and a state where the paper supported on the ribs while displaced in the direction of scanning, respectively.
Figure 5B:
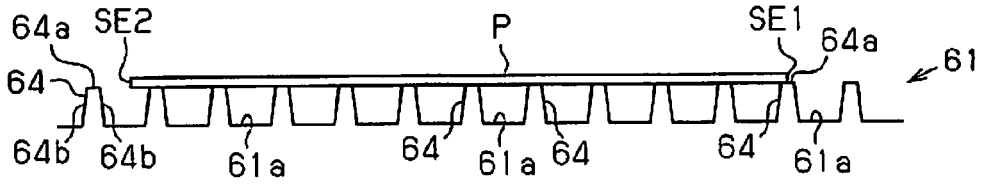

The positions of the plurality of first ribs 64 are set so that the positions of the side ends SE1, SE2 of the paper P on both sides of the width direction will not overlap with any of the first ribs 64 when the paper is fed to a proper position in a case where the paper P is a fixed-form paper of a standard size such as postcard paper, B5 paper, A4 paper, B4 paper, or A3 paper, as illustrated in FIG. 5A. The positions of the plurality of first ribs 64 are also set so that the second side end SE2 will not reach a position overlapping with the position of a first rib 64 in a case where the first side end SE1 is at a position overlapping with the position of a first rib 64, as illustrated in FIG. 5B.

The light reflectance of the upstream support surface part 61 is much lower than the reflectance of the paper P.

This is due to the fact that at least the first ribs 64 have undergone a surface treatment for lowering the light reflectance. Accordingly, the paper width sensor 56 causes the upstream support surface part 61 to become a dark region and the paper P to become a bright region. When a spotlight of the paper width sensor 56 crosses over the side end of the paper P, then the amount of reflected light received by the paper width sensor 56 changes considerably, and this major change point in the amount of light received is detected, whereby the side end position of the paper P is detected.

Incidentally, the top surfaces 64*a* of the first ribs 64 are abraded by the sliding of the paper P and gradually become increasingly mirror-like, causing the light reflectance thereof to gradually rise. Even when the light reflectance of the top surfaces 64*a* has become higher than a predetermined value, the accuracy of detection of the position of the first side end SE is not affected provided that the paper P be in a proper positional range illustrated in FIG. 5A. However, the first side end SE1 of the paper P may in some instances overlap with a first rib 64 in a case where skewing with conveyance oblique to the direction of conveyance Y has taken place or where feeding has proceeded to a position somewhat displaced in the direction of scanning X from the proper position during the course of conveyance of the paper P, as illustrated in FIG. 5B. The accuracy of detection of the position of the first side end SE1 is reduced in the state where there is overlap between a first rib 64 of which the light reflectance has risen to a predetermined value or higher and the side end position of the paper P. In particular in the case of the first method, the print start position is determined on the basis solely of the positional data of the first side end SE1, which includes a detection error, and therefore there will be the problems of positional displacement of the printed image with respect to the paper P or of fouling of the support base 60 by ink that has been ejected beyond the paper P.

Therefore, in the present embodiment, in a case where the position of the first side end SE1 of the paper P has been determined to overlap with the position of a first rib 64 in a case where the light reflectance of the top surfaces 64*a* is estimated to have risen above a predetermined value, then the position of the first side end SE1 as detected is not used, and the position of the first side end SE1 is found with the other method. More specifically, in a case where the light reflectance of the top surfaces 64*a* has been estimated to have risen above a predetermined value in the first method, then the first side end SE1 is detected as one example of one end position, and in a case where the first side end SE1 as detected is determined to overlap with the position of a first rib 64, then the detected position is not used, out of concern that the detected position of the first side end SE1 comprises a detection error that exceeds what is allowable. Then, the second side end SE2 is detected as one example of another end position, and the position of the first side end SE1 is found on the basis of the detected position of the second side end SE2. The side end detection driving for detecting the second side end SE2 is not carried out in a case where the first side end SE1 has been determined not to overlap with the position of a first rib 64.

In the second method, even though the positional data about the first side end SE1 as detected may include a detection error, the mean value of the first side end position and the second side end position is taken as a width center position of the paper P, a position obtained by moving this width center position by half of the difference (the paper width) between the first side end position and the second side end position to a negative side (home position side) in the direction of scanning is found, and this position is determined to be the first side end position. For this reason, any detection error for the first side end position is substantially halved, and therefore there is not as much a problem as there is in the first method.

Herein, a method of driving the carriage 22 in a case where the side end position of the paper P is being detected with the first method shall be described in brief, with reference to FIG. 6. As illustrated in FIG. 6, after completion of the feeding operation until the print start position of the paper P, a first side end detection driving is carried out, in which the carriage 22 is moved from a detection start position SP1 on the paper P illustrated in FIG. 6B to a detection end position EP1 located further outward than the first side end SE1 of the paper P. In the course of this first side end detection driving, the first side end SE1 of the paper P is detected on the basis of the detection signal of the paper width sensor 56. In a case where the position of the first side end SE1 as detected overlaps with the position of a first rib 64, then a second side end detection driving is carried out in which the carriage 22 is moved from the detection start position SP1 on the paper P illustrated in FIG. 6C to a detection end position (not shown)

located further outward than the second side end SE2 of the paper P. In the course of this second side end detection driving, the second side end SE2 of the paper P is detected on the basis of the detection signal of the paper width sensor 56.

Figure 4:
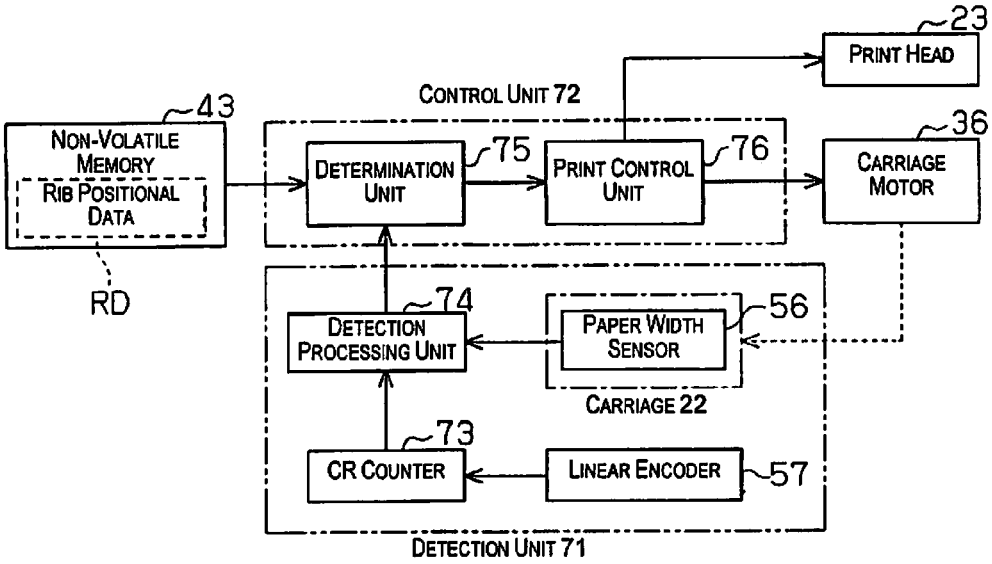
FIG. 4 is a block diagram illustrating a functional configuration of a computer.

FIG. 4 is a functional block diagram as in a paper end detection control constructed inside the computer 40; the printer 11 is provided with a detection unit 71 for detecting the side ends of the paper P and a control unit 72 for governing a variety of controls that include the paper end detection process. The control unit 272 is provided with a durability flag for managing when the abrasion caused by the sliding of the paper P has caused the light reflectance of the top surfaces 64*a* of the first ribs 64 to rise so much that a detection error could be included. The control unit 72 is provided with a counter (not shown) for counting a cumulative number of printed sheets since the start of usage of the printer 11, and turns the durability flag off ("0") so long as the cumulative number of printed sheets is a threshold value or lower but turns the durability flag on ("1") when the cumulative number of printed sheets exceeds the threshold value. The cumulative number of printed sheets is used as an indicator indicative of the light reflectance of the first ribs 64, which is changed by the abrasion with the paper P. In the event that the cumulative number of printed sheets has exceeded the threshold value, then the light reflectance due to abrasion of the first ribs 64 is indirectly deemed to have exceeded a threshold value at which the first side end position as detected when the first side end SE1 was at a position overlapping with a first rib 64 can be regarded as including an error in excess of an allowable range.

In the present embodiment, the side end position detection process for the paper P by the computer 40 is carried out only for the first sheet of the paper P in a single print job. This is because a single print job has the same type of paper, the same paper size, and the same feeding origin (either the feeding cassettes 16, 17 or the feeding tray 19), and there is a high tendency for any skewing during feeding or any positional displacement in the width direction to be substantially the same between the sheets of paper P being fed on the same feed path. The control unit 72 is provided with a paper flag for managing whether or not the paper P being fed is the first sheet of paper of a print job, and turns the paper flag on ("1") when the paper is the first sheet of paper in a single print job but turns the paper flag off ("0") when the paper is the second or later sheet of paper P.

The computer 40 carries out the side end detection driving when the paper flag is on, but does not carry out the side end detection driving when the paper flag is off. The computer 40 then does not carry out the second side end detection driving but rather employs the first side end position as detected at the time so long as the durability flag is off, even though the first side end as detected may overlap with a first rib 64 in a case where the side end detection driving is carried out with the first method. In turn, the computer 40 does carry out the second side end detection driving and determines the first side end position on the basis of the second side as detected at the time, but only when the first side end position as detected by the first side end detection driving overlaps with a first rib 64 in a case where the side end detection driving is being carried out with the first method and where the durability flag is on at the time.

As illustrated in FIG. 4, the detection unit 71 is provided with the linear encoder 57, a CR counter 73, the paper width sensor 56, and a detection processing unit 74. The CR counter 73 is reset when the carriage 22 is at the origin position, adds "1" to the count value every time the edge of the pulse signal from the linear encoder 57 is sensed during forward motion of the carriage 22, and subtracts "1" from the count value every time the edge of the pulse signal from the linear encoder 57 is sensed during the return motion thereof. This causes the CR counter 73 to output a count value corresponding to the position (carriage position) of the carriage 22 in the direction of scanning X.

The detection processing unit 74 finds the position of the first side end SE1, which corresponds to the position of the paper width sensor 56, from the carriage position as ascertained from the count value of the CR counter 73 when a detection voltage Vd from the paper width sensor 56 in the course of the first side end detection driving, which is carried out by moving the carriage 22 in the direction of scanning X, after the end of feeding of the paper P to the print start position and before the start of printing. The detection processing unit 74 then sends the positional data about the first side end SE1 thus found to the control unit 72.

The control unit 72 is provided with a determination unit 75 and a print control unit 76. The determination unit 75 compares rib positional data RD that is read in from the non-volatile memory 43 and the positional data about the first side end SE1 inputted from the detection unit 71, and determines whether or not the position of the first side end SE1 overlaps with the position of a first rib 64.

Herein, the rib positional data RD is positional data defining positional ranges of the first ribs 64 (see FIG. 3). For example, among a number k of first ribs 64, the position of an n-th (where n is a natural number; 1, 2, . . . , k) from the home position HP side (see FIG. 7C) is defined by a positional range from one edge position xns to another edge position xne in the direction of scanning X of the top surface 64*a* of the first rib 64. The determination unit 75 determines that the position of the first side end SE1 and the position of a first rib 64 overlap when the position of the first side end SE1 as detected is within the rib positional range (xns to xne), and determines that the position of the first side end SE1 and the position of the first rib 64 do not overlap in a case where the position of the first side end SE1 is not within the rib positional range (xns to xne) (see FIG. 7A). This determination result is sent from the determination unit to the print control unit 76.

The print control unit 76 governs the motor control and print head control necessary for printing. Included in the control that is carried out by the print control unit 76 are the conveyance control for feeding and conveying the paper P, the carriage control (scan control) for moving the carriage 22 in the direction of scanning, the motor control for the side end detection driving for detecting the side end position of the paper P, and the like. The print control unit 76 controls the driving of the carriage motor 36 during the side end detection driving, and causes the carriage 22 to move in the direction of scanning X with a predetermined path for when the side end position of the paper P is being detected.

In a case where a determination result to the effect that the first side end position and the rib positions do not overlap is received from the determination unit 75, then the print control unit 76 determines that the data for that side end position x1 (see FIGS. 7A and 7B) is the first side end position. In other words, the second side end detection driving for detecting the second side end position is not carried out. In a case where a determination result to the effect that the first side end position and a rib position do intersect is received from the determination unit 75, however, then the print control unit 76 understands there to be an included detection error and does not determine the data of that side end position x11 (see FIGS. 7C and 7D) is the first side end position but rather carries out the other detection driving to determine first side end position. Namely, the print control unit 76 carries out the second side end detection driving comprising the carriage driving for detecting the second side end SE2 of the paper P, as the other detection driving. Then, the print control unit 76 receives the positional data about the second side end SE2 as detected by the detection unit 71 and finds the first side end position on the basis of the second side end position. Herein, because the paper size can be ascertained from the printing condition information in the print data, the first side end position x1 (=x2−Wp) is determined from the second side end position x2 and the paper width Wp identified from the paper size. Alternatively, the first side end position x1 (=(x11+x2)/2−Wp/2) is determined by subtracting the value of half of the paper width Wp from the value of the center position between the first side end position x11 and the second side end position x2.

The print control unit 76 also executes a print process on the basis of the data of the first side end position x1.

The data of the first side end position x1 is used in the determination of the print start position at which the print head 23 starts ejecting the ink in the direction of scanning X. For example, in a case where a margin of a predetermined width has been set for both sides of the paper P in the width direction, then the paper control unit 76 determines a paper start position with which a margin as per the setting is ensured from the data of the first side end position x1. When the ink is ejected beyond the paper P by the print head 23, the support base 60 will be fouled by the ink. For this reason, the print control unit 76 identifies a portion of the print image data that would go beyond the outside of the paper P, on the basis of the data of the first side end position x1, and carries out a mask process for prohibiting printing in at least a part of this portion that goes beyond. This mask processing reduces fouling of the support base 60 by the ink, which is caused by when the ink is ejected to the outside of the paper P.

The print control unit 76 is also provided with a PF counter (not shown) for ascertaining the position of conveyance of the paper P. The PF counter is reset when the paper detection sensor 55 has sensed the leading end of the paper P during feeding. Then, the print control unit 76 recognizes the position of conveyance of the paper P during printing from the count value of the PF counter, which counts the number of pulse edges of the encoder 58, and stops the conveyed paper P at the next target position (print position). In FIG. 4, the detection processing unit 74, the determination unit 75, and the print control unit 76 are functional portions that are constructed inside the computer 40 by the execution of a paper end detection control program illustrated in FIG. 8. These functional portions may be constituted of software, or constituted of cooperation between software and hardware, or constituted of hardware.

Figure 7A:
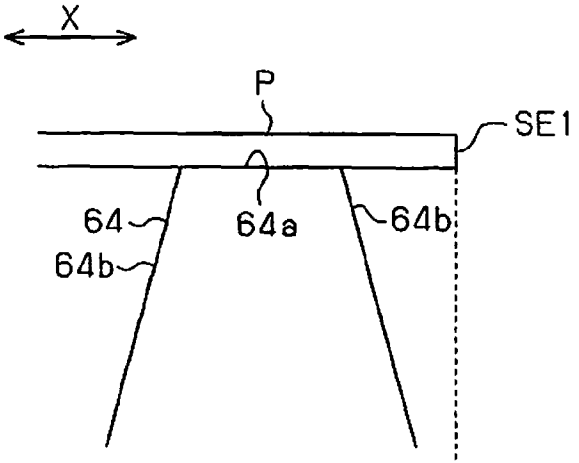
FIG. 7A is an enlarged front view illustrating the state where the paper is supported on the ribs without displacement in the direction of scanning.
Figure 7B:
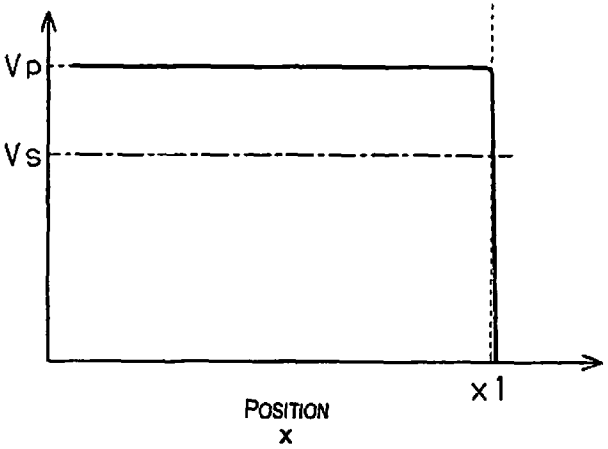
FIG. 7B is a graph illustrating the detection voltage of a sensor upon detecting a side end of the paper when in the state in FIG. 7A.

As illustrated in FIG. 7A, in a case where the paper P has been conveyed to within the proper positional range in the direction of scanning X with respect to the first ribs 64, then the first side end of the paper P is arranged at a position extending slightly more outward (to the right in FIG. 7A) than the top surfaces 64*a* of the first ribs 64 in the direction of scanning X (see also FIG. 5A). In such a case, no top surface 64*a* of any first rib 64 is present in the vicinity of the first side end, and there is no impact on when the first side end is detected even were the light reflectance of the top surfaces 64*a* to have become higher. For this reason, as illustrated in FIG. 7B, a detection voltage Vd of the paper width sensor 56 will take a paper detection voltage Vp higher than a threshold value Vs while the reflected light from the surface of the paper P is being received, and will drop suddenly and fall considerably below the threshold value Vs when the spotlight of the paper width sensor 56 crosses over the first side end. The position of the paper width sensor 56 when the detection voltage Vd goes below the threshold value Vs from the paper detection voltage Vp is detected as the first side end position x1.

Figure 7C:
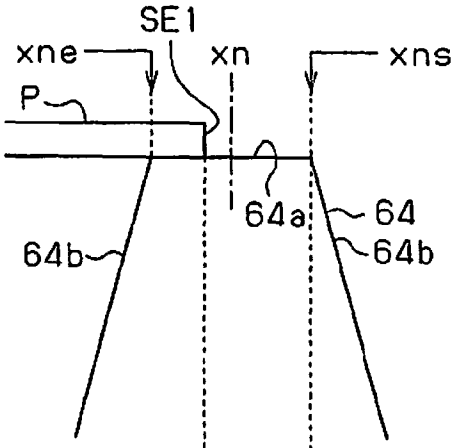
FIG. 7C is an enlarged front view illustrating the state where the paper is supported on the ribs while displaced in the direction of scanning.
Figure 7D:
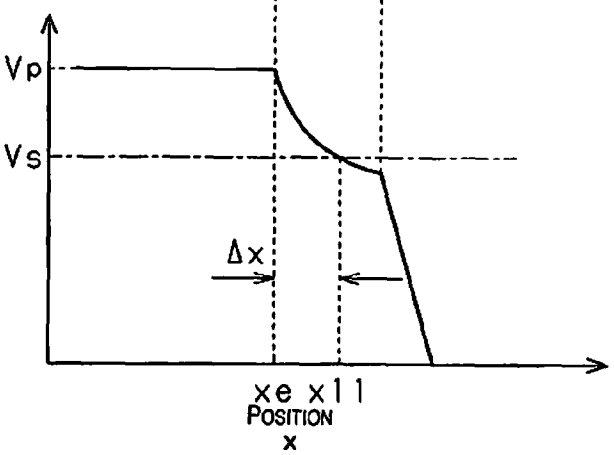
FIG. 7D is a graph illustrating the detection voltage of a sensor upon detecting a side end of the paper when in the state in FIG. 7C.

As illustrated in FIG. 7C, however, in a case where the paper P has been fed with displacement by a predetermined distance or greater from the proper positional range in the direction of scanning X, then the first side end SE1 of the paper P is located within the positional range of a top surface 64*a* of a first rib 64 in the direction of scanning X, and overlaps with the first rib 64 (see also FIG. 5B). In such a case, the first side end SE1 is adjacent to the top surface 64*a*, and should the light reflectance of the top surface 64*a* have become higher due to abrasion, then the accuracy of detection of the position of the first side end SE1 is degraded under the influence of the reflected light from the top surface 64*a*. For this reason, as illustrated in FIG. 7D, the detection voltage Vd of the paper width sensor 56 gradually decreases so as to trace a curve from the paper detection voltage Vp of when only the paper P was irradiated with the spotlight, due to the received light of the comparatively strong reflected light coming from the top surface 64*a*, even when the spotlight of the paper width sensor 56 has crossed over the first side end SE1. The voltage will consequently fall below the threshold value Vs at the first side end position x11 that is displaced further outward by a distance Δx than the actual first side end position xe. For this reason, the first side end position x11, which includes an unacceptable detection error amounting to the distance Δx, is detected.

Figure 6A:
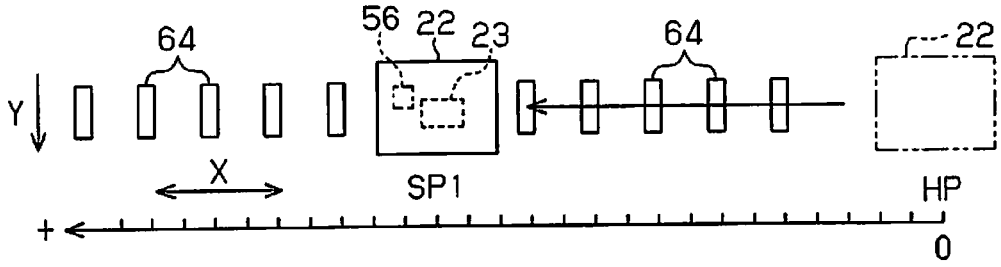
FIGS. 6A, 6B, and 6C and 6D are schematic plan views illustrating a carriage moving to a detection start position, a side end detection driving in a case where the paper is not displaced in the direction of scanning, and a side end detection driving in a case where the paper has been displaced in the direction of scanning, respectively.

Next, a method of driving the carriage 22 pertaining to the paper end detection control shall now be described in greater detail, with reference to FIG. 6. In FIG. 6, the direction where the carriage 22 draws away from the home position HP (the left direction in FIG. 6) is understood to be the positive direction, and the direction of approach to the home position HP (the right direction in FIG. 6) is understood to be the negative direction. As illustrated in FIG. 6A, the carriage 22 moves from the home position Hp to a detection start position SP1 (the solid line position in FIG. 6A) for the first side end detection, until the document loading operation for the paper P is completed. Herein, the detection start position SP1 is located within the width of the paper P, and is set to a position at which the spotlight of the paper width sensor 56 hits the surface of the paper P. The range where the paper P is present in the direction of scanning X is ascertained from data about the paper size in the print condition information that is included in the print job data at that time. The detection start position SP1 is set to a carriage position at which the spotlight of the paper width sensor 56 can hit a position on the paper going inward (inward in terms of the width of the paper) by a set distance (for example, a value in the range of 1 to 10 cm) in the direction of scanning from the middle position (width center position) of the paper P in the direction of scanning X or from the position of the first side end SE1 of the paper P as assumed from the paper size at that time. The carriage 22 may be moved to the detection start position SP1 from the home position HP after the completion of the document loading operation for the paper P. In such a case, the throughput is reduced, but an event where the surface of the paper rubs against the print head during the loading can be reliably avoided.

Figure 6B:
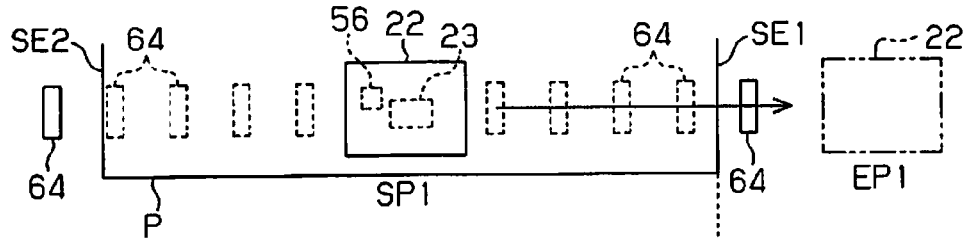

As Illustrated In FIG. 6B, the first side end detection driving is carried out, in which the carriage 22 is moved at a set speed from the detection start position SP1 to the negative side (the right side in FIG. 6B) in the direction of scanning; then, the first side end SE1 of the paper P is detected in the course of this movement. FIG. 6B corresponds to a case where the displacement of the paper P in the direction of scanning X illustrated in FIG. 5A is within the allowable range; at this time, the first side end position x1 of the paper P is detected.

Figure 6C:
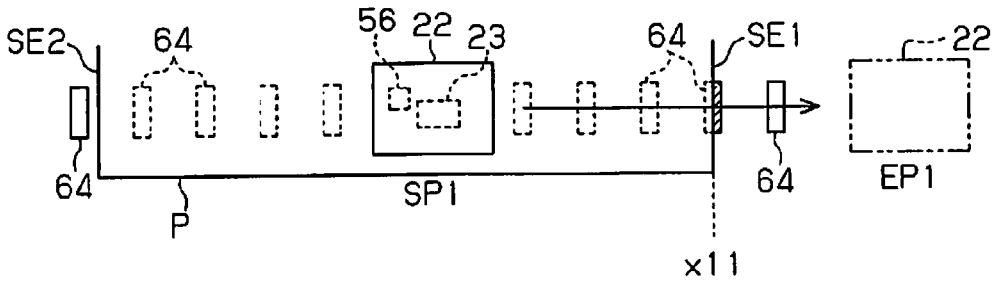

FIG. 6C, in turn, corresponds to a case where the displacement of the paper P in the direction of scanning X illustrated in FIG. 5B has exceeded the allowable range and therefore the position of the first side end SE1 of the paper P overlaps with the position of a first rib 64.

In such a case, when abrasion with the paper has caused the light reflectance of the first ribs 4 to rise, the reflected light from the portion illustrated with hatching in FIG. 6C has an impact, and therefore there is the concern that an unacceptable detection error is included in the first side end position x11 of the paper P as detected with the first side end detection driving in which the carriage 22 moves from the detection start position SP1 to the negative side in the direction of scanning X.

Figure 6D:
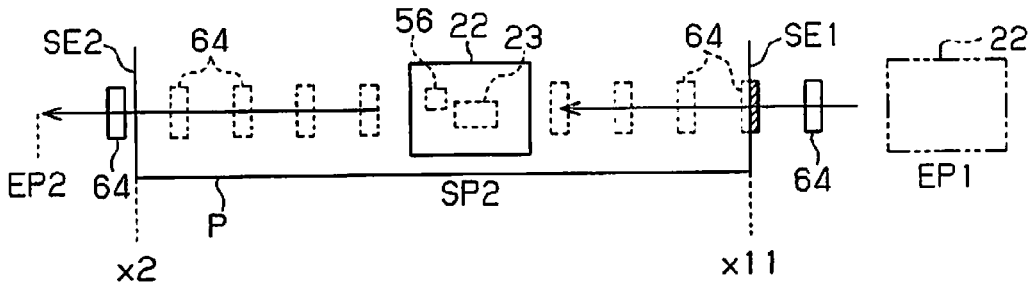

In such a case, as illustrated in FIG. 6D, the carriage 22 is moved at a set speed from a detection start position SP2 (the solid line position in FIG. 6D) to a detection end position EP2 on the positive side (the left side in FIG. 6D) in the direction of scanning X, and the second side end SE2 of the paper P is detected in the course of this movement. In a case where the paper P is fixed-form paper, then when the position of the first side end SE1 overlaps with the position of the first rib 64, the position of the second side end SE2 does not overlap with the position of a first rib 64, and therefore the second side end position x2, which has little detection error, is detected. The detection start position SP1 for the first side end detection driving and the detection start position SP2 for the second side end detection driving may be set to different positions; for example, the former may be set to a position closer to the first side end SE1 than the width center of the paper P, and the latter may be set to a position closer to the second side end SE2 than the width center of the paper P.

Next, an action of the printer 11 shall be described.

The paper end detection, which is carried out within the printer 11 by the computer 40 executing the paper end detection control program illustrated with a flow chart in FIG. 8, shall be described. The computer 40 starts the printing by the printer 11 upon receiving print job data and accepting a print execution instruction based on a command therein. The computer 40 acquires necessary information, such as the print mode and the paper size, on the basis of the print condition data in the print job data. The computer 40 determines whether to use the first method or the second method depending on the print mode acquired. The computer 40 furthermore sets the print flag to "1", because the printing is for the first sheet of paper of the print job. However, so long as the cumulative number of printed sheets counted since the start of usage of the printer 11 is not greater than the threshold value, the durability flag will be off ("0"); the durability flag will become on ("1") after the cumulative number of printed sheets has exceeded the threshold value.

In a case where the second method has been determined, then the carriage 22 is moved from the home position HP to the positive side in the direction of scanning X, and arranged at the detection start position SP1. Then, the carriage 22 is moved from the detection start position SP1 toward the detection end position EP1 to the negative side in the direction of scanning X, and the first side end position x1 of the paper P is detected in the course of this movement. Thereafter, the carriage 22 is moved to the positive side in the direction of scanning X and arranged at the detection start position SP2, then moved therefrom toward the detection end position EP2 to the positive side; the second side end position x2 of the paper P is detected in the course of this movement.

Then, the mean value of the two side end positions x1, x2 is calculated to find the width center position xc of the paper P; the first side end position is determined to be a position that is to the negative side by a distance of ½ the paper width Wp (=x2−x1) from the width center position xc.

Should the paper flag be "1" indicating that the paper is the first sheet of the print job when the first method has been determined, however, then the computer 40 executes the paper end detection control in accordance with the flow chart illustrated in FIG. 8. The paper end detection control by the first method shall be described below with reference to FIGS. 6 and 8.

First, in a step S11, the carriage 22 is moved to the detection start position. More specifically, the control unit 72 drives the carriage motor 36 and causes the carriage 22 to move from the home position HP to the detection start position SP1. In the example in FIG. 6A, the detection start position SP1 has been set to, for example, the width center position of the paper P, but it suffices for the detection start position SP1 to be more to the positive side (inward in the paper) in the direction of scanning X than the first side end SE1 of the paper P, in accordance with the paper size being fed at that time.

In a step S12, the paper P is conveyed to a loading position. More specifically, the control unit 72 drives the feed motor 37 and the conveyance motor 38 and conveys the paper P to a loading position at which the printing is started.

In a step S13, the first side end detection driving is carried out in which the carriage 22, which is at the detection start position, is driven in the direction (the negative side in the direction of scanning) in which it is possible to cross over the first side end, and the first side end is detected. More specifically, the control unit 72 drives the carriage motor 36 and, as illustrated in FIGS. 6B and 6C, causes the carriage 22 to move at a set speed from the detection start position SP1 (the solid line position in FIGS. 6B and 6C) to the negative side (the right side in FIGS. 6B and 6C) in the direction of scanning X; the first side end SE1 of the paper P is detected in the course of movement of the carriage 22. At this time, the detection unit 71 reads the rib positional data RD from the non-volatile memory 43 and determines whether or not the detection voltage Vd of the paper width sensor 56 crosses over the threshold value Vs (see FIGS. 7B, 7D) while also monitoring by comparing the position of the paper width sensor 56, as determined from the carriage position indicated with the count value of the CR counter 73, against the rib positional data RD. Then, when the detection voltage Vd crosses over the threshold value Vs, the first side end position x1 (or x11) is found from the carriage position of the CR counter 73 at that time.

The detection unit 71 is unable to detect the first side end SE1 in a case where, for example, the feeding of the paper P has failed because of a paper jam or the like and the side end detection of the paper P by the paper width sensor 56 is impossible, or a case where paper P of a long width that is greater than expected is fed. In terms of the latter instance, there is the following case. The paper width sensor 56 is arranged offset to the positive side in the direction of scanning X with respect to the carriage 22, and making it possible to detect the first side end of the largest paper necessitates lengthening the printer body in the width direction, but there is then the problem where the body is increased in size. For this reason, as regards the largest paper, it is the second side end SE2, which is on the opposite side to the home position-side first side end SE1 in the direction of scanning X, which will be detected; any increase in the size of the printer body in the width direction is avoided. In this kind of printer 11, largest paper that is different from the setting could be erroneously fed out due inter alia to an incorrect inputting of the setting for the paper size, mistaken placement of paper of a paper size different from the setting in the feeding cassettes 16, 17 or the like, in which case the paper width sensor 56 is unable to reach the position facing the first side end SE1 even though the first side end detection driving is carried out, and the first side end SE1 is not detected.

In a step S14, a determination is made as to whether or not the first side end has been detected. The flow advances to a step S15 in a case where the detection unit 71 was able to detect the first side end SE1 during the movement of the carriage 22. In a case where the detection unit 71 was unable to detect the first side end SE1, however, then the flow advances to a step S23 and error processing is carried out. In one example of the error processing, the display unit 14 displays an error message prompting confirmation of whether or not the paper size was wrong, or the like. This routine is concluded after the error processing has been carried out. Thereafter, the computer 40 again starts this routine when a user, having removed the cause of the error, instructs that the printing should be started (resumed) with an operation of the operation unit 15.

In a step S15, a determination is made as to whether or not the durability flag is on ("1"). More specifically, the flow proceeds to a step S16 in a case where the cumulative number of printed sheets since the start of usage of the printer has exceeded the threshold value and the durability flag is on ("1"). In other words, the flow proceeds to the step S16 in a case where the cumulative number of printed sheets has exceeded a threshold value that is set out of concern that the higher the abrasion due to sliding of the paper P has raised the light reflectance of the top surfaces 64*a*, relatively, the more detection error is included. In a case where the durability flag is off ("0") and the cumulative number of printed sheets since the start of usage of the printer has not exceeded the threshold value, then the flow proceeds to a step S17, and the first side end position x1 is determined to be the position detected by the detection unit 71 in the steps S13, S14.

In the step S16, a determination is made as to whether or not the first side end position overlaps with a rib position. More specifically, whether or not the first side end position x1 or x11 as detected is within the positional range of a first rib 64 is determined by the determination unit 75 of the control unit 72 on the basis of the rib positional data RD that was read from the non-volatile memory 43. The determination unit 75 determines that the first side end position and the rib position overlap when the first side end position x1 or x11 as detected is within the rib positional range (xns to xne) of the n-th first rib 64 (where n is a natural number; 1, 2, . . . , k), and determines that the first side end position and the rib position do not overlap in a case where the first side end position is not within the rib positional range (xns to xne). At this time, the determination may be made one at a time in order from the first of the first ribs 64, or the determination may be made in order of proximity from the first rib 64 that is closest to the first side end position assumed for every sheet size.

As illustrated in FIG. 6B, in a case where the displacement of the fed paper P in the direction of scanning X is within the allowable range, the first side end SE1 of the paper P and the first ribs 64 do not overlap, and the first side end position x1 having little detection error is detected. However, as illustrated in FIG. 6C, in a case where the displacement of the fed paper P in the direction of scanning X exceeds the allowable range and the first side end SE1 of the paper P does overlap with a first rib 64, then there is the concern that the impact of the reflected light from the polished surface created by the abrasion of the first ribs 64 as illustrated with hatching in FIG. 6C could cause the first side end position x11, which has an unacceptable detection error, to be detected. For this reason, the flow advances to a step S17 when the first side end position does not overlap with a rib position, and the first side end position x1 is determined to be the position detected by the detection unit 71 in the steps S13, S14. When the first side end position does overlap with a rib position, however, then the flow proceeds to a step S18.

In the step S18, the carriage 22 is moved to a detection start position for the second side end detection.

More specifically, the control unit 72 drives the carriage motor 36 and, as illustrated in FIG. 6D, causes the carriage 22 to move from the detection end position EP1 of the first side end detection driving to the detection start position SP2. The detection start position SP1 for the first side end detection driving and the detection start position SP2 for the second side end detection driving may be the same position or may be different positions that are closer to the respective side end intended to be detected.

In a step S19, the second side end detection driving is carried out, in which the carriage 22, which is at the detection start position, is driven to the positive side in the direction of scanning X in which it is possible to cross over the second side end, and the second side end SE2 is detected. More specifically, the control unit 72 drives the carriage motor 36 and, as illustrated in FIG. 6D, causes the carriage 22 to move at a set speed from the detection start position SP2 to the detection end position EP2 of the positive side (the left side in FIG. 6D) in the direction of scanning X; the second side end SE2 of the paper P is detected in the course of movement of the carriage 22. At this time, when the first side end SE1 overlaps with a first rib 64 in a case where the paper P is fixed-form paper, then the second side end SE2 does not overlap with a first rib 64, and therefore the second side end position x2, which has little detection error, is detected.

In a step S20, a determination is made as to whether or not the second side end SE2 has been detected. The flow advances to a step S21 in a case where the detection unit 71 was able to detect the second side end SE2 during the movement of the carriage 22. In a case where the detection unit 71 was unable to detect the second side end SE2, however, the flow advances to a step S23, and the aforementioned error processing is carried out. After the error processing has been carried out, the computer 40 again starts this routine when a user, having removed the cause of the error, instructs that the printing should be started (resumed) with an operation of the operation unit 15.

In a step S21, the first side end position is determined on the basis of the second side end position. There are two methods for determining the first side end position x1 on the basis of the second side end position x2. One is to have the first side end position x1 be a position that has been moved by a distance amounting to the paper width Wp to the negative side in the direction of scanning X from the second side end position x2. At this time, for the paper width Wp, the paper width Wp determined from the paper size in the print condition information set by the user may be used, or the paper width Wp as found by calculating the difference between the first side end position x11 and the second side end position x2 may be used. The former paper width Wp has the concern that the wrong first side end position may have been determined due to the user mistakenly inputting the wrong setting for the paper size, a set-up mistake where paper of the wrong size was placed in the feeding cassettes 16, 17, or the like, but in contrast thereto, the latter paper width Wp is an actually measured value and is relatively accurate. For this reason, it is more preferable to use the paper width Wp of the actually measured value, in that a mistaken determination of the first side end position is less likely to occur.

The other is similar to the second method and comprises finding the mean value of the first side end position x11 and the second side end position x2 as the width center position xc of the paper width P, and determining the first side end position x1 to be a position that has been moved by a distance ½ of the paper width Wp from this width center position xc to the negative side in the direction of scanning X.

At this time, too, the paper width Wp used should be a theoretical paper width Wp (theoretical value) determined from the paper size in the print condition information set by the user, or, alternatively, the actually measured paper width Wp as found from the difference between the first side end position x11 and the second side end position x2. When the first side end position x1 is determined in this manner in the steps S16, S21, the flow proceeds to a step S22.

In the step S22, a print process is executed on the basis of the first side end position. More specifically, the print control unit 76 finds the print start position for starting the ejection of the ink in the course of movement in the direction of scanning X by the print head 23, on the basis of the data of the first side end position x1. In the example of a case where a margin of a predetermined width has been set on both sides of the width direction of the paper P, the print control unit 76 determines the print start position to be a position to the positive side in the direction of scanning X by a distance amounting to the margin as set (side margins) from the data of the first side end position x1. In order to prevent ink from being ejected beyond the paper P by the print head 23, which would then foul the support base 60 with the ink, the print control unit 76 identifies a portion of the print image data that would go beyond the outside of the paper P, on the basis of the data of the first side end position x1. The print control unit 76 then subjects the print image data to a mask process for prohibiting printing in another region, of this portion that goes beyond, that leaves a slight margin (allowable amount of going beyond) to the outside of the first side end of the paper P. This mask process considerably reduces the ink that is ejected beyond the outside of the paper P, and makes it possible to suppress fouling of the support base 60 by ink that has gone beyond.

The print start position may also be found on the basis of the each of the values of the second side end position x2, the paper width Wp, and the amount of margin of the first side end (side margin), without finding the first side end position. A mask process may also be carried out in which the first side end position is not found, and printing in a going-beyond prohibition region of the print image is prohibited on the basis of each of the values of the second side end position x2, the paper width Wp, and the allowable amount of going beyond. In such cases, too, the first side end position is determined indirectly.

According to the present embodiment as described above, it is possible to obtain the following effects.

(1) When the first side end position of the paper P is detected by the paper width sensor 56, in a case where the first side end position as detected is a position that overlaps with the position of a first rib 64 based on the rib positional data RD stored in the non-volatile memory 43, then the other second side end position x2 of the paper P is detected and the first side end position x1 is determined on the basis of the second side end position x2. For this reason, the first side end position of the paper P can be determined relatively accurately even when the first side end position of the paper P overlaps with the position of a first rib 64 and the accuracy of detection of the first side end position by the paper width sensor 56 is decreased.

(2) The first side end position x1 is determined by comparing the first side end position as detected by the paper width sensor 56 with the theoretical position of the first side end position x1 as based on the detected second side end position x2 and on information about the paper P (paper size information in the print condition information). Accordingly, the first side end position x1 can be determined even more accurately.

(3) In a case where the first side end position x1 is a position that does not overlap with the position of a first rib 64, then the second side end detection driving for detecting the second side end position x2 is not carried out, and therefore the time needed to detect the first side end position x1 is reduced by a commensurate amount.

(4) In a case where the first side end position x11 is a position that does overlap with the position of a first rib 64, then because the positions of the plurality of first ribs 64 have been set so that the second side end position x2 will not overlap with the position of a first rib 64, the second side end position x2 can be accurately detected without hindrance from the first ribs 64.

As a result, the first side end position x1 can be accurately determined on the basis of the second side end position x2.

(5) In a case where the side end positions x11, x2 of both the first side end position x11 and the second side end position x2 are detected, then the first side end position x1 is determined on the basis of the actually measured paper width Wp (=x2−x11) as found on the basis of the two side end positions x11, x2. Accordingly, the more highly accurate first side end position x1 can be determined.

(6) In a case where the light reflectance of the first ribs 64 has been determined to be the threshold value or lower, then even in a case where the first side end position x11 and the position of a first rib 64 do overlap, the second side end detection driving for detecting the second side end position x2 is not carried out, and therefore the time needed to detect the first side end position is reduced by a commensurate amount. In particular, the determination that the light reflectance of the first ribs 64 is a threshold value or lower is carried out by determining whether or not the cumulative number of printed sheets is a threshold value or lower. Accordingly, there is no need to measure the light reflectance or the amount of light reflected, and therefore the excess driving for measurement can be forgone. As such, it is possible to reduce the time needed to detect the side end positions and the printing can be started quickly, and therefore the printing throughput can be improved.

(7) In a case where both the side end positions x11, x2 have been detected, then the paper width Wp of the paper P in the direction of scanning X is found as the actually measured value of the paper P on the basis of the two side end positions x11, x2, and the first side end position x1 is determined on the basis of the paper width Wp and the second side end position x2. Accordingly, the first side end position x1 can be accurately determined on the basis of an actually measured value. In the example of a case where the paper width Wp (theoretical value) as determined from the paper size information in the print condition information is used, then the first side end position x1 would be the wrong one in a case where the user has inputted a setting with the wrong paper size information or has loaded the wrong paper. By contrast, in the case where the actually measured value of the paper P is used, then it is easy to avoid the unfavorable situation where the wrong first side end position is determined, as could arise in a case where the theoretical value is used.

(8) In a case where an index indicative of the extent of abrasion of the first ribs 64 is a threshold value or lower, then the accuracy of detection of the first side end position is relatively high even in a case where the first side end position as detected and the position of a rib as stored in the non-volatile memory 43 overlap, and therefore the second side end position x2 is not detected. For this reason, the time needed to detect the side end position can be shortened by a commensurate amount. In turn, in a case where the index indicative of the extent of abrasion of the first ribs 64 has exceeded the threshold value, then the second side end position x2 is detected and the first side end position x1 is determined on the basis of the second side end position x2 in a case where, when the first side end position is detected by the paper width sensor 56, the first side end position is a position that overlaps with a rib position based on the rib positional data stored in the non-volatile memory 43. Accordingly, the first side end position can be accurately determined.

(9) The question of whether or not the paper is the first sheet of paper P in the print job is determined by the print flag, and the process to determine the first side end position by the paper side end detection driving is carried out only for the first sheet of paper P. Accordingly, the first side end position as determined with the first sheet is used for the second and subsequent sheets of paper, thereby making it possible to forgo the side end detection driving and improve the printing throughput.

The embodiments described above can also be altered to the following modes.

In the above embodiment, the position of the home position-side first side end SE1 out of the two side ends of the paper P in the width direction is understood to be one end position, and the position of the second side end SE2 on the opposite side thereof is understood to be the other end position, but the inverse may also be applied. That is to say, the position of the home position-side first side end SE1 may be understood to be the other end position, the position of the second side end SE2 o the opposite side thereof may be understood to be the one end position. In such a case, the second side end position should be detected first, and in a case where the second side end position and a rib position overlap, then the first side end would be detected and the second side end position would be determined from the resulting first side end position.

The second side end position x2 (one example of the other end position) as detected by the paper width sensor 56 is compared with the second side end position (the theoretical position of the other end position) calculated on the basis of the first side end position x11 and the paper width Wp determined from the paper size, serving as one example of information about the print medium. The configuration may then be such that according to this comparison, when the detected position of the second side end position is within an allowable range with respect to the theoretical position of the second side end position, the determination is made with the first side end position x11 as detected, but when the detected position is not within the allowable range, the determination is made with the first side end position as calculated on the basis of the second side end position x2 and the paper width Wp.

As the method of detecting the end position of the print medium, two different methods were prepared, a first method and a second method, depending on the print mode, but there configuration may be such that there is only the first method, or such that there are three or more different methods including the first method.

In the above embodiment, the side end detection driving was carried out only for the first sheet of paper P in the print job, but the side end detection driving may also be carried out for a sheet of paper other than the first in the print job, or alternatively for all of the sheets of paper.

The determination of whether or not the light reflectance (i.e., the extent of abrasion) of the ribs is the threshold value or below was carried out by determining whether or not the cumulative number of printed sheets is the threshold value or below, but another index indicative of the change in light reflectance due to abrasion of the ribs may also be used. For example, the cumulative amount of ink ejected or the number of times the ink cartridge has been replaced may be selected as an index; then, a determination would be made as to whether or not the selected index is a threshold value or below. In such a case, the configuration may be such that a determination is made as to whether or not each of a plurality of indices is a respective threshold value or below, and the second side end detection driving is carried out in a case where the threshold value is exceeded in all of the plurality of indices.

Also, the amount of reflected light of the first ribs 64 may be detected by the paper width sensor 56 in a state where the first ribs 64 are not covered with paper, a determination then being made as to whether or not the threshold value is exceeded by the light reflectance of the first ribs 64 as unambiguously determined from that amount of reflected light. In this manner, a determination may be made directly as to whether or not the light reflectance of the first ribs 64 exceeds the threshold value. The driving of the carriage 22 for detecting the amount of reflected light of the first ribs 64 is preferably carried out during an initiation operation when the printer 11 is powered on or during a standby period when printing is not happening.

In the above embodiment, the configuration may be such that the determination using the durability flag is discarded, and from the first print job at the start of usage of the printer, in a case where the first side end position and the position of rib overlap, then the second side end detection for detecting the second side end position x2 is carried out and the first side end position is determined from the second side end position x2. For example, the light reflection-preventing surface treatment layer of the ribs may be discarded.

The convexities (ribs) were understood to be the first ribs 64, located on the upstream side in the direction of conveyance Y from the print region PA, but the paper width sensor 56 may be provided to a position corresponding to the second ribs 65 or the third ribs 66, causing the second ribs 65 or third ribs 66 to then be one example of the convexities. The first through third ribs may also be replaced by ribs that are connected to one body in the direction of conveyance. Also, the ribs may be provided at irregular intervals in the direction of scanning X, or there may be a mixture of a plurality of kinds of ribs with which the ribs have different widths and/or heights. In the example of a case where there is a mixture of a plurality of kinds of ribs having different heights, only the high ribs where abrasion with the paper could arise may be understood to be one example of convexities; in a case where there is the concern that the detection of the side end position of the paper could be impacted by the reflected light coming from the low ribs, as well, then both the high ribs and the short ribs may be understood to be one example of convexities. Grooves may also be formed in the top surfaces of the ribs. The shape of the ribs may also be changed to a shape that is appropriate, provided that it remains possible to support the print medium.

In the above embodiment, the one end position (first side end position) was actually determined, but the one end position need not actually be determined; instead, another position unambiguously determined by when the one end position is determined, e.g., a print start position or mask position, may be found directly from the other end position (the second side end position). In a case where the act of determining the print start position, the mask position, or another such position by finding same from the other end position also means that the other position is unambiguously determined from the one end position, then the one end position would be determined indirectly. In this manner, the one end need not be determined directly, but rather may be determined indirectly by determining the other position (the print start position or the mask position).

The paper width sensor 56, serving as one example of a detection unit, is not limited to being an optical sensor. It suffices for the paper width sensor 56 to be a non-contact sensor. For example, the paper width sensor 56 may be a proximity sensor or an electromagnetic induction sensor.

The paper width sensor 56 may also be a magnetic sensor capable of detecting an end position in a print medium which is made of metal or contains a metal layer or metal particles, or a print medium that has been magnetized. The paper width sensor 56 may moreover be an image sensor for detecting the end position of the print medium by capturing an image. In the case of an image sensor, too, it suffices for the one end position to be determined from the detected value of the other end position in a case where the detection accuracy has declined because the paper and the top surfaces of the ribs have become the same color or similar colors.

The feeding apparatus may be a format for feeding out a roll of paper serving as one example of a print medium.

The feed motor and the conveyance motor may be replaced by a single conveyance motor shared by the feeding system and the conveyance system. In such a case, then when, for example, the conveyance motor is driven in a state where a power transmission switching unit has been switched to a switch position for feeding, the outputted rotation thereof is transmitted to the respective rollers of the feeding system and the conveyance system.

The print medium is not limited to being paper, and may be a resin film, a metal foil, metal film, a composite film of resin and metal (a laminate film), a woven fabric, a non-woven fabric, a ceramic sheet, or the like. The print medium may also be a three-dimensional object.

The print apparatus may be an inkjet printer, a dot impact printer, or a laser printer, provided that the print apparatus be capable of printing onto a medium such as the paper P. The print apparatus is moreover not limited to being one that is provided solely with a print function, and may be a multi-function peripheral.

The print apparatus is also not limited to being a serial printer, and may be a line printer or a page printer.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A print apparatus, comprising:

a carriage including a print head configured to print onto a print medium and a non-contact detection unit configured to detect ends of the print medium in a direction of scanning intersecting with a direction of conveyance of the print medium, the carriage being configured to scan in the direction of scanning;

a plurality of convexities arranged at positions facing a scanning region of the carriage and arranged along the direction of scanning in a state of extending along the direction of conveyance;

a conveyance unit configured to convey the print medium over the convexities;

a storage unit storing the positions of the convexities; and a control unit configured to control the print apparatus, the control unit being further configured to determine whether or not a light reflectance of the convexities exceeds a threshold value, and determine whether or not one end position of the print medium is an overlapping position that overlaps with the positions of the convexities stored in the storage unit when determining that the light reflectance of the convexities exceeds the threshold value, when the non-contact detection unit detects the one end position, in a case where the control unit determines that the light reflectance of the convexities exceeds the threshold value, and determines that the one end position is the overlapping position, the control unit being configured to control the non-contact detection unit to detect the other end position of the print medium and configured to determine the one end position based on the other end position.

2. The print apparatus as set forth in claim 1, wherein the one end position is determined by comparing the other end position as detected by the non-contact detection unit with a theoretical position of the other end position as based on information about the print medium.

3. The print apparatus as set forth in claim 1, wherein the other end position is not detected in a case where the one end position is a position that does not overlap with the convexities.

4. The print apparatus as set forth in claim 1, wherein when the control unit determines that the light reflectance of the convexities is the threshold value or below, the control unit is configured not to control the non-contact detection unit to detect the other end position and is configured to determine the one end position that has been detected as the one end position in a case where the one end position that has been detected is the overlapping position that overlaps with the positions of the convexities stored in the storage unit.

5. A print apparatus, comprising:

a carriage including a print head configured to print onto a print medium and a non-contact detection unit configured to detect ends of the print medium in a direction of scanning intersecting with a direction of conveyance of the print medium, the carriage being configured to scan in the direction of scanning;

a plurality of convexities arranged at positions facing a scanning region of the carriage and arranged along the direction of scanning in a state of extending along the direction of conveyance;

a conveyance unit configured to convey the print medium over the convexities;

a storage unit configured to store the positions of the convexities; and a control unit configured to control the print apparatus, when the non-contact detection unit detects one end position of the print medium, in a case where the one end position is a position that overlaps with positions of the convexities stored in the storage unit, the control unit being configured to control the non-contact detection unit to detect the other end position of the print medium and configured to determine the one end position based on the other end position, the positions of the plurality of the convexities being set such that the other end position is a position that does not overlap with the positions of the convexities in a case where the one end position is a position that overlaps with the convexities.

6. The print apparatus as set forth in claim 5, wherein the control unit is configured to determine the one end position based on actually measured values based on both of the one end position and the other end position in a case where the one end position and the other end position have both been detected.

7. The print apparatus as set forth in claim 6, wherein the control unit is further configured to determine the one end position based on an average value calculated by averaging the actually measured values of the one end position and the other end position when the one end position is the position that overlaps with the convexities and the other end position is the position that does not overlap with the positions of the convexities.

8. A print apparatus, comprising:

a carriage including a print head configured to print onto a print medium and a non-contact detection unit configured to detect ends of the print medium in a direction of scanning intersecting with a direction of conveyance of the print medium, the carriage being configured to scan in the direction of scanning;

a plurality of convexities arranged at positions facing a scanning region of the carriage and arranged along the direction of scanning in a state of extending along the direction of conveyance;

a conveyance unit configured to convey the print medium over the convexities;

a storage unit configured to store the positions of the convexities; and a control unit configured to control the print apparatus, the control unit being further configured to determine whether or not a light reflectance of the convexities exceeds a threshold value, when the non-contact detection unit detects one end position of the print medium, in a case where the control unit determines that the light reflectance of the convexities exceeds the threshold value and the one end position is a position that overlaps with positions of the convexities, the control unit being configured to control the non-contact detection unit to detect the other end position of the print medium and configured to determine the one end position based on the other end position, in a case where the control unit determines that the light reflectance of the convexities is a threshold value or below, the control unit being configured not to control the non-contact detection unit to detect the other end position in a case where the one end position and the positions of the convexities overlap.

* * * * *